US005332874A

United States Patent [19]

Orr et al.

[11] Patent Number: 5,332,874

[45] Date of Patent: Jul. 26, 1994

[54] CONTROL DEVICE AND METHOD OF MAKING THE SAME

[75] Inventors: Kenneth J. Orr, Caledonia; Brian J. Kadwell, Holland, both of Mich.

[73] Assignee: RobertShaw Controls Company, Richmond, Va.

[21] Appl. No.: 4,683

[22] Filed: Jan. 14, 1993

[51] Int. Cl.[5] ..... H01H 3/12

[52] U.S. Cl. ..... 200/58; 200/4

[58] Field of Search ..... 200/5 R, 5 A, 5 B, 5 E, 200/50 C, 4, 18, 17 R, 512, 513, 514, 515, 516, 517

[56] References Cited

U.S. PATENT DOCUMENTS

| | | | |
|---|---|---|---|
| 4,029,915 | 6/1977 | Ojima | 200/5 A |
| 4,401,864 | 8/1983 | Ichikawa | 200/17 R |
| 4,554,426 | 11/1985 | Caste | 200/5 A |
| 4,689,455 | 8/1987 | Watanabe | 200/340 |
| 4,760,218 | 7/1988 | Gutman | 200/5 R |
| 4,795,862 | 1/1989 | Linden | 200/6 A |

*Primary Examiner*—A. D. Pellinen
*Assistant Examiner*—Michael A. Friedhofer
*Attorney, Agent, or Firm*—Candor, Candor & Tassone

[57] ABSTRACT

A control device and method of making the same are provided, the control device comprising a single movable actuator member having two spaced apart plungers respectively operatively associated with and in axial alignment with movable parts of two switch units and having two actuator buttons thereon respectively in axial alignment with the plungers and the parts of the switch units, the member being pivotally mounted to a support of the control device so that the member actuates only one of the two switch units when the member ms moved to one pivoted position thereof by an axial force applied to the button that is in axial alignment with the part of the one switch unit and actuates only the other of the two switch units when the member is moved to another pivoted position thereof by an axial force applied to the other of the buttons that is in axial alignment with the part of the other switch unit.

5 Claims, 3 Drawing Sheets

CONTROL DEVICE AND METHOD OF MAKING THE SAME

BACKGROUND OF THE INVENTION

1. Field of the Invention

This invention relates to a new control device, such as a clock and/or a timer, as well as to a new method of making such a control device.

2. Prior Art Statement

It is known to provide a control device comprising a support means, two switch means carried by the support means in spaced apart relation and each having a movable part thereof that actuates the respective switch means when that part is axially moved a certain distance in a certain direction, and movable actuator means carried by the support means for operating the parts of the two switch means, the actuator means comprising a single member having two spaced apart plungers respectively operatively associated with and in axial alignment with the parts of the two switch means and having two actuator buttons thereon respectively disposed inboard the two plungers and the parts of the switch means whereby pushing in on either one of the buttons first actuates the switch means closest to that button and then actuates the other switch means upon further inward movement of that button.

SUMMARY OF THE INVENTION

It is one of the features of this invention to provide a new control device wherein unique actuator means are provided for operating a pair of switch means of the control device.

In particular, it was found according to the teachings of this invention that a single member actuator means can be provided and have the actuator buttons thereof disposed in axial alignment with plungers on the member treat are in axial alignment with movable parts of the switch means to be actuated thereby whereby inward movement on one of the buttons will cause pivotal movement of the member and only actuate the one switch means in axial alignment therewith whereby in order to actuate the other switch means, the other button must be pushed axially inwardly to pivot the member in such a manner that the other plunger only actuates the other switch means that is in alignment with that other button.

For example, one embodiment of this invention comprises a control device comprising a support means, two switch means carried by the support means in spaced apart relation and each having a movable part thereof that actuates the respective switch means when that part is axially moved a certain distance in a certain direction, and movable actuator means carried by the support means for operating the parts the two switch means, the actuator means comprising a single member having two spaced apart plungers respectively operatively associated with and in axial alignment with the parts of the two switch means and having two actuator buttons thereon respectively in axial alignment with the plungers and the parts of the switch means, the member being pivotally mounted to the support means so that the member actuates only one the two switch means when the member is moved to one pivoted position thereof by an axial force applied to one of the buttons that is in axial alignment with the part of the one switch means and actuates only the other of the two switch means when the member is moved to another pivoted position thereof by an axial force applied to the other of the buttons that is in axial alignment with the part of the other switch means.

Accordingly, it is an object of this invention to provide a new control device having one or more on the novel features of this invention as set forth above or hereinafter shown or described.

Another object of this invention is to provide a new method of making such a control device, the method this invention having one or more of the novel features this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
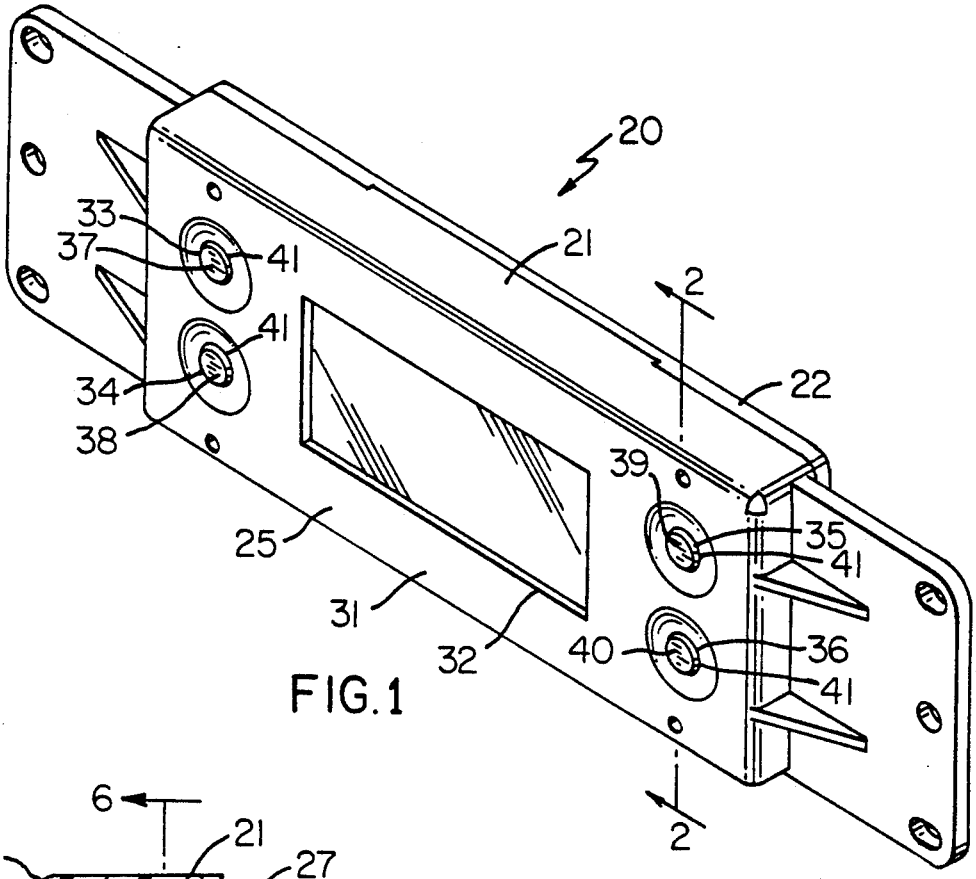
FIG. 1 is a perspective view of the new control device of this invention.

While the various features of this invention are hereinafter illustrated and described as being particularly adapted to provide a control device having a clock and a timer, it is to be understood that the various features of this invention can be utilized singly or in various combinations thereof to provide a control device for controlling other functions as desired.

Therefore, this invention is not to be limited to only the embodiments illustrated in the drawings, because the drawings are merely utilized to illustrate one of the wide variety of uses of this invention.

Referring now to FIGS. 1–7, the new control device of this invention is generally indicated by the reference numeral 20 and comprises a support means 21, the support means 21 comprising a circuit board means 22 having a substantially flat printed circuit and solder side 23 and an opposite substantially flat component mounting side 24 and a cover means 25 having a front plate-like part 26 that is spaced from the solder side 24 of the board 22 and is carried by the board 22 by having a plurality of posts 27 thereof disposed through openings 28 passing through the board 22 and being secured thereto in any suitable manner, such as by adhesive means or the like.

Therefore, the cover member 25 and the board 22 cooperate to form a cavity or chamber 29 between the solder side 23 of the board 22 and a facing side 30 of the front plate or part 25 that has an exposed or outer side 31.

As illustrated in FIG. 1, the cover member 25 has a window 32 therein for exposing a vacuum fluorescent display unit or the like for indicating the time of day, a timer setting, etc. as controlled by a plurality of push buttons 33, 34, 35 and 36 that respectively have pushing surfaces 37, 38, 39 and 40 extending out of openings 41 passing through the front part of the cover member 25.

While the push buttons 33–36 can be utilized for any suitable purpose, one working embodiment of the control device 20 of this invention permits the user to push inwardly on the surface 37 of the push button 33 to select a clock time setting mode of the control device 20 and then utilize the push button 35 to increase the indicated time at the window 32 by pushing inwardly on the surface 39 of the push button 35 or to lower the indicated time as indicated at the window 32 by pushing inwardly on the surface 40 of the push button 36 until the desired indicated time appears at the window whereby the clock function of the control device 22 will have the time setting thereof set at the selected time.

The control device 20 in such one working embodiment utilized the push button 34 for selecting a timer mode of the control device 20 so that when the user pushes inwardly on the surface 38 of the push button 34, a timer mode has been selected and the selected timer period will appear at the window 32 which can be increased in value by the user pushing inwardly on the surface 39 of the button 35 until the selected time period appears at the window 32. However, should the user overshoot the selected time, then that user can lower the time appearing at the window 32 by pushing inwardly on the surface 40 of the button 36 until the desired time period appears at the window 32.

Since such selection of the indicated time of day and the selection of a timer period are functions well known in the art for an electronic control device, it is deemed unnecessary to further describe such functions as such push buttons 33–36 each operate any suitable electrical switch means carried by the board 22 and having any suitable construction wherein a movable part of that switch means is spring biased to one condition or stage so as to force the respective button outwardly and have the condition or stage thereof changed when the respective push button is pushed inwardly to move that movable part to another position thereof in opposition to the force of the spring means.

In the embodiment illustrated in the drawings the push buttons 35 and 36 respectively control electrical switch means 42 and 43 with each switch means 42 and 43 identical in construction and being a type well know in the art.

Figure 2:
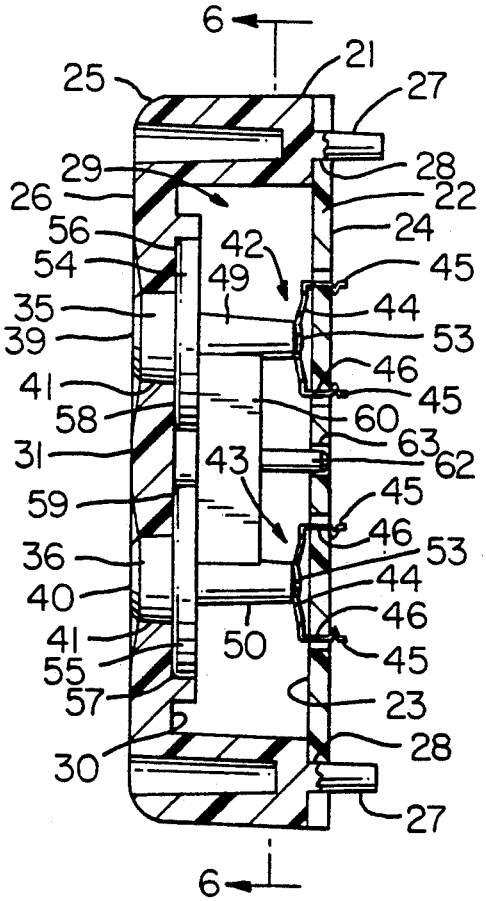
FIG. 2 is an enlarged cross-sectional view taken on line 2—2 of FIG. 1.

For example, each switch means 42 and 43 comprises a movable metallic part 44 that is normally urged outwardly to the position illustrated in FIG. 2 by the natural resiliency of the part 44 and has mounting legs 45 snap fitted through suitable openings 46 formed through the board 22 to mount the same to the solder side 23 of the board 22. Each switch means 42 and 43 has terminal-like portions 47, FIG. 7, on the outer periphery of the member 44 which are electrically interconnected to printed circuit means on the side 23 of the board 22 in a manner well known in the art whereby movement of the 44 of the respective switch means 42 or 43 inwardly against the side 23 of the board 22 by inward movement on its respective button 35 or 36 as illustrated respectively in FIGS. 3 and 4 changes the state of the respective switch means 42 and 43; such as causes a closing of the switch means 42 and 43, and upon releasing of the particular button 35 or 36, the natural resiliency of the part 44 pushes back outwardly away from the side 23 of the board 22 to the non-actuated condition of the switch means 42 or 43 as illustrated in FIG. 2.

The push buttons 35 and 36 of the control device 20 comprise part of an actuator means of this invention that is generally indicated by the reference numeral 48 and comprises a single or one-piece member formed of any suitable electrically insulating material, such as molded plastic material, and being shaped to define two spaced apart plunger means 49 and 50 respectively having substantially flat free ends 51 and 52 for respectively engaging against central portions 53 of the movable members 44 of the respective switch means 42 and 43 when the actuator means 48 is disposed in the cavity 29 of the control device 20 so as to have the push buttons 35 and 36 thereof disposed in the openings 41 in the front plate 26 and have enlarged disc-like portions 54 and 55 thereof received in cooperating recesses 56 and 57 formed in the side 30 of the part 26 of the cover member 25 as illustrated in FIGS. 2–4 and 6.

In this manner, the surfaces 58 and 59 of the respective discs 54 and 55 are normally urged against the side 30 of the front part 26 of the cover member 25 by the natural resiliency of the members 44 of the switch means 42 and 43 in the manner illustrated in FIG. 2 whereby the movable parts 44 of the switch means 42 and 43 are normally disposed in one condition thereof.

The actuator means 48 has a web 60 interconnecting the plungers 49 and 50 together as well as to the disc members 54 and 55 thereof, the web 60 having a post 61 extending outwardly therefrom and being provided with a free end 62 that is received in an opening 63 passing through the board 22 intermediate the switch means 42 and 43 as illustrated in the drawings.

Figure 3:
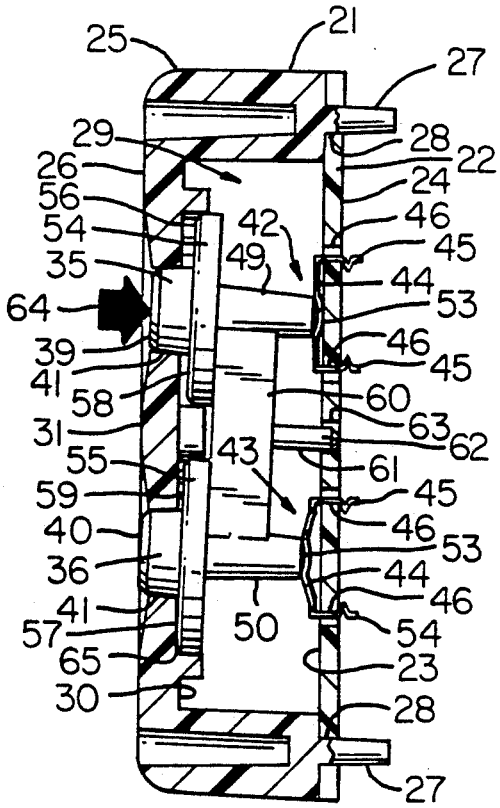
FIG. 3 is a view similar to FIG. 2 and illustrates the top button of the actuator means of the control device being utilized to actuate one of the switch means thereof.

From the above, it can be seen that the plungers 49 and 50 as well as the push buttons 35 and 36 of the actuator means 48 are disposed in axial alignment with the center portions 53 of the movable parts 44 of the respective switch means 42 and 43 so as to operate in a manner hereinafter set forth to cause only the switch means 42 to be operated when the push button 35 is moved inwardly as illustrated in FIG. 3 and to cause only the switch means 43 to be operated when the push button 36 is pushed inwardly in the manner illustrated in FIG. 4.

In particular, with the actuator means 48 disposed in its at rest or out position as illustrated in FIG. 2 wherein both switch means 42 and 43 are each in one condition or state thereof, such as being open, should a person push inwardly on the push button 35 in the manner illustrated by the arrow 64 in FIG. 3, the plunger means 49 will cause the movable part 44 of the switch means 42 to move inwardly until the central portion 53 thereof engages the solder side 23 of the board 22 and completes a circuit means on the circuit board 23 in manner will known in the art and thereby terminates inward movement of the plunger 49, the actuator means 48 pivoting at a pivot point means 65 as illustrated in FIG. 3 while the post 61 moves in the opening 63 to permit such pivoting movement of the actuator means 48 so that the switch means 43 cannot be operated by the push button 35 during its operation of the switch means 42.

Thereafter, if the person releases the push button 35, the natural resiliency of the part 44 of the switch means 42 moves the plunger 49 and, thus, the button 35 outwardly back to the position illustrated in FIG. 2 wherein the side 58 of the disc 54 engages the side 30 of the front plate 26 as illustrated in FIG. 2 and the switch means 42 returns from its closed condition of FIG. 3 to open condition of FIG. 2.

Figure 4:
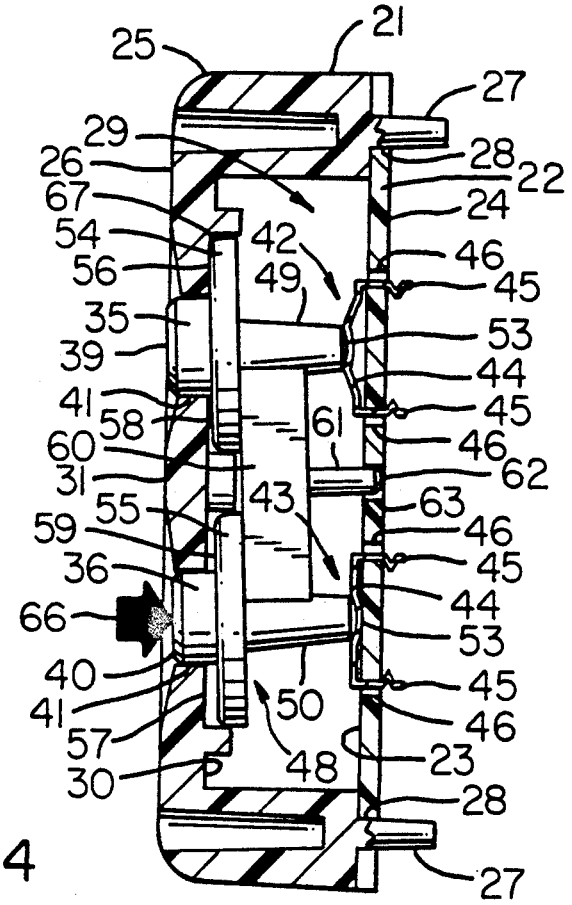
FIG. 4 is a view similar to FIG. 2 and illustrates the lower actuator button being utilized to actuate the lower switch means thereof.
Figure 5:
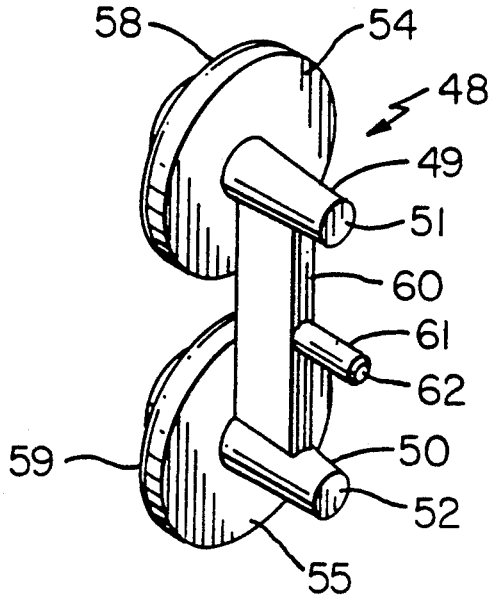
FIG. 5 is a perspective view of the actuator means of the control device of FIGS. 1–4.
Figure 6:
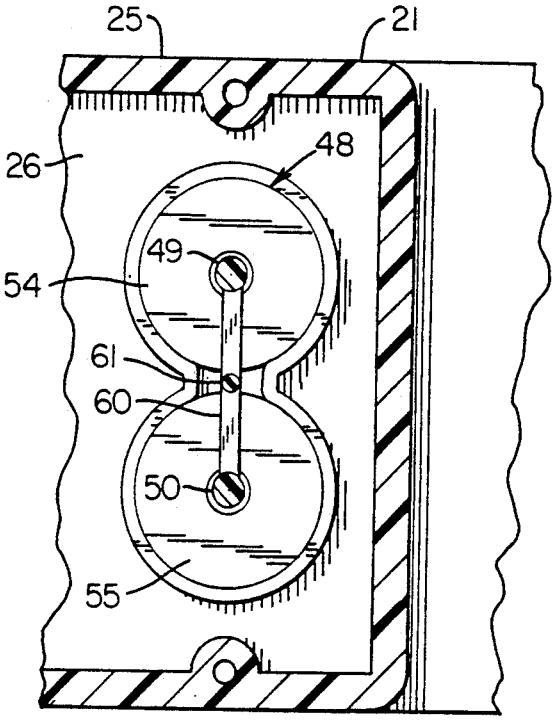
FIG. 6 is a fragmentary cross-sectional view taken on line 6—6 of FIG. 2, FIG. 6 having been rotated 180°.
Figure 7:
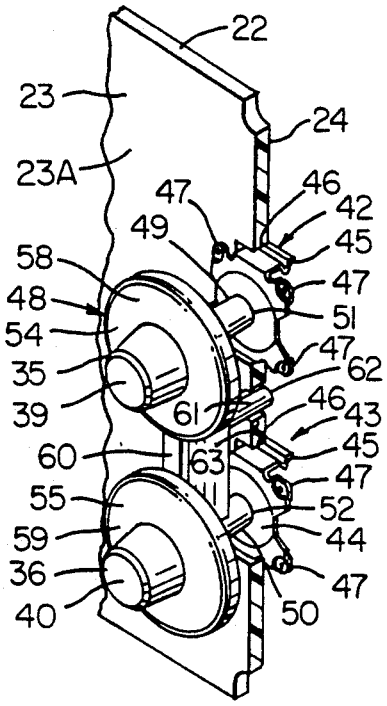
FIG. 7 is a fragmentary perspective view of the actuator means of the control device of FIGS. 1–6 with the front cover means removed.

When a person desires to operate the switch means 43, the person pushes inwardly on the button 36 in the manner indicated by the arrow 66 in FIG. 4 whereby the actuator means pivots on the pivot point means 67 as illustrated in FIG. 4 so that the plunger 50 moves the movable part 44 of the switch means 43 inwardly until the same bottoms out against the side 23 of the board 22 as illustrated in FIG. 4 and completes a circuit means so as to change the state or condition of the switch means 43, such as closing the switch means 43. Subsequently, releasing of the button 36 permits the natural resiliency of the part 44 of the switch means 43 to move back outwardly to the position illustrated in FIG. 2 wherein the surface 59 of the disc 55 of the actuator means 48 engages against the surface means 30 of the front plate 26 as illustrated in FIG. 2 and the switch means 30 of the front plate 26 as illustrated in FIG. 2 and the switch means 43 returns to its open condition.

Figure 8:
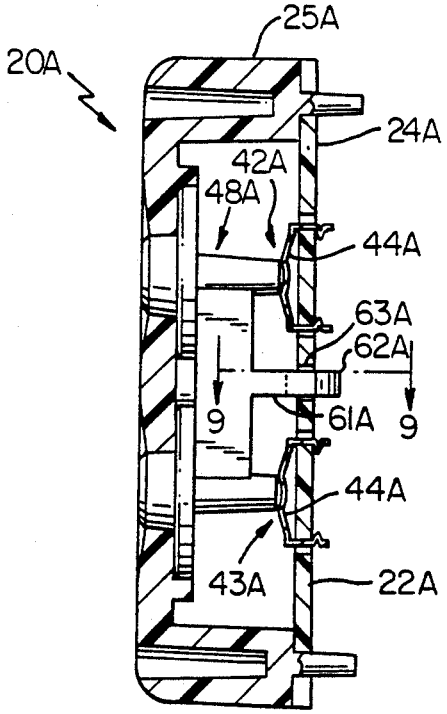
FIG. 8 is a view similar to FIG. 2 and illustrates another control device of this invention.
Figure 9:
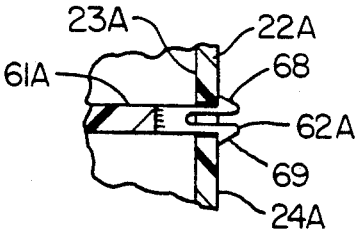
FIG. 9 is a fragmentary cross-sectional view taken on line 9—9 of FIG. 8.
Figure 10:
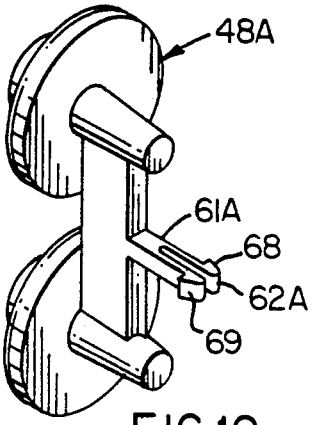
FIG. 10 is a perspective view of the actuator means of the control device of FIGS. 8 and 9.

Another control device of this invention is generally indicated by the reference numeral 20A in FIGS. 8–10 and parts thereof similar to parts of the control device 20 previously described are indicated by like reference numerals followed by the reference letter "A"

As illustrated in FIGS. 8–10, the control device 20A is substantially identical to the control device 20 previously described except that the post 61A of the actuator means 48A has the free end 62A thereof bifurcated and defining two parts 68 and 69 which are adapted to snap fit through the opening 63A in the board 22A and engage against the side 24A thereof when the actuator means 48A is in the at rest position illustrated in FIG. 8.

In this manner, the actuator means 48A can be assembled to the board 22A and will remain attached thereto even though the cover means 25A has not been placed on the board 22A as the spring means of the movable parts 44A of the switch means 42A and 43A tending to push the actuator means 48A outwardly away from the solder side 23A of the board 22A causes the parts 68 and 69 of the post 61A of the actuator means 48A to engage against the side 24A of the board 22A and thereby remain attached thereto.

However, the actuator means 48A cooperates with the cover means 25A once the sa/ne is attached to the board 22A to control the switch means 42A and 43A in substantially the same manner as the actuator means 48 previously described and therefore a further description of the operation of the control device 20A is deemed unnecessary.

Therefore, it can be seen that this invention not only provides a new control device, but also this invention provides a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device comprising a support means, two switch means carried by said support means in spaced apart relation and each having a movable part thereof that actuates the respective switch means when that said part is axially moved a certain distance in a certain direction, and movable actuator means carried by said support means for operating said parts of said two switch means, said support means comprising a generally flat surface means having said switch means thereon, said support means comprising a cover means carried by said surface means and having a part thereof spaced from said surface means with said part of said cover means having opposed surfaces, said actuator means being disposed between said surface means and said part of said cover means and normally being held against one of said opposed surfaces by said switch means, the improvement wherein said actuator means comprises a single member having two spaced apart plungers respectively operatively associated with and in axial alignment with said parts of said two switch means and having two actuator buttons thereon respectively in axial alignment with said plungers and said parts of said switch means, said member having two circular disc-like portions respectively disposed between the axially aligned actuator buttons and their respective plungers and in axially aligned relation therewith while extending radially outwardly from the respective actuator buttons, said part of said cover means having two separate openings passing therethrough and receiving said actuator buttons therein, said part of said cover means having two circular recesses in said one of said opposed surfaces thereof and respectively receiving said disc-like portions of said member therein, said member being pivotally mounted to said support means by said disc-like portions and their respective recesses so that said member actuates only one of said two switch means when said member is moved to one pivoted position thereof by an axial force applied in said certain direction to one of said buttons that is in axial alignment with said part of said one switch means and actuates only the other of two two switch means when said member is moved to another pivoted position thereof by an axial force applied in said certain direction to the other of said buttons that is in axial alignment with said part of said other switch means.

2. A control device as set forth in claim 1 wherein said switch means have spring means tending to move said parts thereof outwardly to certain positions thereof whereby said parts thereof must respectively be moved inwardly by said plungers to change the state of said switch means.

3. A control device as set forth in claim 1 wherein said support means has an opening passing through said surface means intermediate said switch means, said member having a post extending therefrom intermediate said plungers and projecting into said opening.

4. A control device as set forth in claim 3 wherein said post has a free end, said surface means having opposed surfaces, said switch means being carried on one of said opposed surfaces of said surface means, said free end of said post extending beyond the other of said opposed surfaces of said surface means.

5. A control device as set forth in claim 4 wherein said free end of said post snap-fits against the other of said opposed surfaces of said surface means when said free end of said post is initially pushed through said opening means from said one surface thereof to said other surface thereof.

* * * * *